US008414092B2

(12) United States Patent
Zalewski et al.

(10) Patent No.: US 8,414,092 B2
(45) Date of Patent: Apr. 9, 2013

(54) STORAGE AND ORGANIZATION SYSTEM WITH STACKABLE SHELLS

(75) Inventors: Kevin Zalewski, Rochester Hills, MI (US); Dirk Ahlgrim, Cambridge, MA (US); Monica Kuznik, Padua (IT); Samuel Palmer, Arlington, MA (US); Gretchen Wustrack, San Francisco, CA (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/372,064

(22) Filed: Feb. 13, 2012

(65) Prior Publication Data

US 2012/0139397 A1 Jun. 7, 2012

Related U.S. Application Data

(63) Continuation of application No. 12/554,028, filed on Sep. 4, 2009, now Pat. No. 8,113,600, which is a continuation of application No. 61/161,019, filed on Mar. 17, 2009.

(51) Int. Cl.
*F16B 12/00* (2006.01)

(52) U.S. Cl.
USPC ..... 312/111; 312/107

(58) Field of Classification Search ..... 312/107, 312/108, 111, 257.1, 263, 265.5
See application file for complete search history.

(56) References Cited

U.S. PATENT DOCUMENTS

| | | | |
|---|---|---|---|
| 1,076,116 | A | 10/1913 | Hatfield |
| 1,694,487 | A | 12/1928 | Ringer |
| 1,799,831 | A | 5/1929 | Pauls |
| 2,121,190 | A | 6/1938 | Fellowes |
| 2,257,536 | A | 9/1941 | Roycroft |
| 2,299,766 | A | 10/1942 | Rosenthal |
| 2,364,083 | A | 12/1944 | Lindsay |
| 2,663,449 | A | 12/1953 | Smart |
| 2,697,631 | A | 12/1954 | Miller |
| 3,027,045 | A | 5/1961 | Wilson |
| 3,117,692 | A | 1/1964 | Carpenter et al. |
| 3,170,594 | A | 2/1965 | Nascher |

(Continued)

FOREIGN PATENT DOCUMENTS

| | | |
|---|---|---|
| AU | B69962/91 | 10/1991 |
| DE | 3020836 A | 12/1981 |

(Continued)

OTHER PUBLICATIONS

"iCube, my cube, my spaceTM", materials publicly provided in an offer to sell the associated product at least as early as Apr. 23, 2008, 22 pages.

(Continued)

*Primary Examiner* — Hanh V Tran

(74) *Attorney, Agent, or Firm* — Griffiths & Seaton PLLC

(57) ABSTRACT

A storage shell includes sidewalls and rails. The sidewalls each extend between two others of the sidewalls to collectively define a chamber therebetween. The sidewalls create a plurality of intersection lines each being defined along a boundary between two of the plurality of sidewalls. The plurality of are rails each coupled to and radially extends away from a different corresponding one of the plurality of intersection lines relative to a center of the storage shell. Each of the plurality of rails is formed with a Y-shaped cross-section. Related storage and organization systems, and methods are also disclosed and provide additional advantages.

20 Claims, 10 Drawing Sheets

U.S. PATENT DOCUMENTS

| | | | |
|---|---|---|---|
| 3,254,440 | A | 6/1966 | Duggar |
| 3,254,786 | A | 6/1966 | Melville |
| 3,279,873 | A | 10/1966 | Gronquist |
| 3,421,656 | A | 1/1969 | Asenbauer |
| 3,468,591 | A | 9/1969 | Wodli |
| 3,506,321 | A | 4/1970 | Hampel |
| 3,552,579 | A | 1/1971 | Simon et al. |
| 3,563,624 | A | 2/1971 | Stice |
| 3,583,780 | A | 6/1971 | Berkowitz |
| 3,655,065 | A | 4/1972 | Yellin |
| 3,661,434 | A | 5/1972 | Alster |
| 3,722,704 | A | 3/1973 | Piretti |
| 3,722,971 | A | 3/1973 | Zeischegg |
| 3,743,372 | A | 7/1973 | Ruggerone |
| 3,822,924 | A | 7/1974 | Lust |
| 3,836,217 | A | 9/1974 | Shiina |
| 3,836,218 | A | 9/1974 | Hallal |
| 3,853,367 | A | 12/1974 | Jamison et al. |
| 3,856,147 | A | 12/1974 | Piretti |
| 3,874,753 | A | 4/1975 | Naito et al. |
| 3,885,845 | A | 5/1975 | Krieks |
| 3,975,877 | A | 8/1976 | Walton |
| 4,047,773 | A | 9/1977 | Semany |
| 4,050,604 | A | 9/1977 | Flanders |
| 4,192,562 | A | 3/1980 | Bishoff et al. |
| 4,196,948 | A | 4/1980 | Gavel et al. |
| 4,261,627 | A | 4/1981 | Felsenthal |
| 4,403,554 | A | 9/1983 | Valentine et al. |
| 4,448,463 | A | 5/1984 | Amos |
| 4,470,647 | A | 9/1984 | Bishoff et al. |
| 4,593,816 | A | 6/1986 | Langenbeck |
| 4,673,087 | A | 6/1987 | Webb |
| 4,704,313 | A | 11/1987 | Maier |
| 4,707,038 | A | 11/1987 | Voegeli |
| 4,717,214 | A | 1/1988 | Moore et al. |
| 4,742,931 | A | 5/1988 | Bennett |
| 4,782,637 | A | 11/1988 | Eriksson et al. |
| 4,782,972 | A | 11/1988 | Wenkman et al. |
| 4,863,222 | A | 9/1989 | Posso |
| 4,903,451 | A | 2/1990 | Gresswell |
| 5,119,610 | A | 6/1992 | Birkeland et al. |
| 5,147,120 | A | 9/1992 | Ray |
| 5,176,435 | A | 1/1993 | Pipkens |
| 5,356,031 | A | 10/1994 | Jondelius |
| 5,357,728 | A | 10/1994 | Duncanson |
| 5,360,263 | A | 11/1994 | Nakano et al. |
| D361,203 | S | 8/1995 | Regnier |
| 5,464,295 | A | 11/1995 | Daillot |
| 5,466,058 | A | 11/1995 | Chan |
| 5,497,888 | A | 3/1996 | Michaels et al. |
| 5,562,224 | A | 10/1996 | Pascal et al. |
| 5,584,412 | A | 12/1996 | Wang |
| 5,615,797 | A | 4/1997 | Ripamonti |
| 5,664,856 | A | 9/1997 | Pacetti |
| 5,680,744 | A | 10/1997 | Kramedjian et al. |
| 5,720,547 | A | 2/1998 | Baird |
| D396,566 | S | 8/1998 | Albrecht |
| 5,888,114 | A | 3/1999 | Slocum et al. |
| 5,902,025 | A | 5/1999 | Yu |
| 5,913,580 | A | 6/1999 | Liu |
| 5,941,616 | A | 8/1999 | Billingham |
| 6,024,626 | A | 2/2000 | Mendelsohn |
| 6,039,202 | A | 3/2000 | Olstad et al. |
| D437,706 | S | 2/2001 | Alcala et al. |
| 6,193,340 | B1 | 2/2001 | Schenker et al. |
| 6,209,976 | B1 | 4/2001 | Shear |
| D454,454 | S | 3/2002 | Hamilton et al. |
| 6,352,323 | B1 | 3/2002 | Rives |
| D455,292 | S | 4/2002 | Hardy et al. |
| 6,536,856 | B2 | 3/2003 | Pelizzari et al. |
| 6,698,853 | B2 | 3/2004 | Chen et al. |
| 6,722,515 | B2 | 4/2004 | Rumpel |
| 6,820,950 | B1 | 11/2004 | Sun |
| 6,834,920 | B2 | 12/2004 | Landsberger et al. |
| 6,942,306 | B2 | 9/2005 | Youngs et al. |
| 6,962,262 | B2 | 11/2005 | Toma |
| 6,966,450 | B2 | 11/2005 | Askew |
| 6,971,529 | B1 | 12/2005 | Shapiro |
| 7,261,219 | B2 | 8/2007 | Tucker et al. |
| 7,472,969 | B2 | 1/2009 | Saravis |
| 7,507,136 | B2 | 3/2009 | Patton |
| D592,402 | S | 5/2009 | Ahlgrim et al. |
| D594,657 | S | 6/2009 | McAlpine |
| D596,857 | S | 7/2009 | Ahlgrim et al. |
| 7,588,162 | B2 | 9/2009 | Dube et al. |
| D602,255 | S | 10/2009 | Ahlgrim et al. |
| 7,621,421 | B2 | 11/2009 | Ohayon |
| D605,896 | S | 12/2009 | Zalewski et al. |
| D617,582 | S | 6/2010 | Zalewski |
| D619,829 | S | 7/2010 | Zalewski et al. |
| D619,832 | S | 7/2010 | Zalewski et al. |
| D622,959 | S | 9/2010 | Zalewski et al. |
| 7,866,769 | B2 | 1/2011 | Ahlgrim et al. |
| D632,892 | S | 2/2011 | Zalewski et al. |
| D634,567 | S | 3/2011 | Zalewski |
| 7,984,820 | B2 | 7/2011 | Dancyger |
| 2002/0093272 | A1 | 7/2002 | Saravis |
| 2002/0109442 | A1 | 8/2002 | Hsu |
| 2002/0125799 | A1 | 9/2002 | Landsberger et al. |
| 2002/0185941 | A1 | 12/2002 | Ferraro et al. |
| 2003/0184199 | A1 | 10/2003 | Jananji |
| 2003/0193274 | A1 | 10/2003 | Saravis |
| 2003/0222545 | A1 | 12/2003 | Stravitz |
| 2004/0164653 | A1 | 8/2004 | Winkless |
| 2004/0217677 | A1 | 11/2004 | Durand et al. |
| 2005/0006991 | A1 | 1/2005 | Saravis |
| 2005/0077805 | A1 | 4/2005 | Dalebout et al. |
| 2005/0088068 | A1 | 4/2005 | Chang |
| 2005/0104483 | A1 | 5/2005 | Saravis |
| 2005/0104484 | A1 | 5/2005 | Landsberger et al. |
| 2005/0168116 | A1 | 8/2005 | Chuang |
| 2005/0264147 | A1 | 12/2005 | Norris et al. |
| 2006/0080928 | A1 | 4/2006 | Kichijo et al. |
| 2006/0244348 | A1 | 11/2006 | Richied et al. |
| 2006/0250052 | A1 | 11/2006 | Davis et al. |
| 2008/0011697 | A1 | 1/2008 | Berg |
| 2008/0017596 | A1 | 1/2008 | Brock |
| 2008/0128428 | A1 | 6/2008 | Beckerman |
| 2008/0258593 | A1 | 10/2008 | Berger |
| 2010/0019630 | A1 | 1/2010 | Leng |
| 2010/0237755 | A1 | 9/2010 | Zalewski |
| 2011/0074255 | A1 | 3/2011 | Ahlgrim et al. |

FOREIGN PATENT DOCUMENTS

| | | | |
|---|---|---|---|
| DE | 3302105 | | 7/1983 |
| DE | 3933611 | | 4/1991 |
| DE | 4313330 | | 9/1994 |
| DE | 19735185 | | 2/1999 |
| DE | 19949849 | | 2/2001 |
| DE | 20309712 | U | 8/2003 |
| EP | 0270495 | | 6/1988 |
| EP | 0614017 | | 9/1994 |
| EP | 0801912 | | 10/1997 |
| FR | 2316679 | | 1/1977 |
| FR | 2376677 | | 8/1978 |
| FR | 2862356 | | 5/2005 |
| GB | 2101202 | A | 1/1983 |
| GB | 2206280 | | 1/1989 |
| GB | 2231820 | A | 11/1990 |
| GB | 2355672 | | 5/2001 |
| GB | 2370239 | A | 6/2002 |
| WO | 8700406 | | 1/1987 |
| WO | 9920153 | | 4/1999 |
| WO | 0127395 | | 4/2001 |

OTHER PUBLICATIONS

Egan Visual, Inc., "Modeular Storage . . . configured to your requirements," 2004, 2 pages.

Egan Visual inc., "Finish Schedule," Price and Specification Guide, Jul. 2002, 11 pages.

Egan Visual, Inc., "Finish Schedule," Price and Specification Guide, Jul. 2002, 3 pages.

Egan Visual, Inc., "Mobile Task Carts & Lockers—Product Design Rationale," 2004, 2 pages.

Moduline Modular Aluminum Cabinets, "Moduline Pro-Series Combinations—Trailer Cabinets Organize With Style!—Modular Aluminum Storage Cabinets," printed from www.modulinecabinets.com in May 2006, 3 pages.

"elfa Platinum Garage System," printed from www.organize.com in May 2006, 2 pages.

"The Cube Storage System," printed from www.organize.com in May 2006, 2 pages.

"Storage Cubes: A Unique 5 Piece Modular Storage System—Cherry," printed from www.organize.com in May 2006, 2 pages.

"elfa basic 9' Double Hang Closet," printed from www.organize.com in May 2006, 2 pages.

"Closits Modular Furniture System—Maple," printed from www.target.com in May 2006, 3 pages.

"QBO Storage Soluation," www.topdeq.com/topdeq/product.do@catid=us_75&prodid=pp_QBO, printed May 2006, 2 pages.

"Cubo Modular Storage," www.topdeq.com/topdeq/product.do@catid=us_75&prodid=pp_QBO, printed May 2006, 3 pages.

Storage Member publicly available in IKEA stores at least as early as Jan. 2000.

Shopwiki, "Oraganizer Bins-Lookers-Locker Organizers-Magnetic Storage bins," http://www.shopwiki.com/_Organizer+Bins+-+Locker+Organizers+-+Magnetic+Storage_Bins, printed on Aug. 2, 2009, 2 pages.

U.S. Appl. No. 29/378,520, filed Nov. 5, 2010, 12 pages.

STORAGE AND ORGANIZATION SYSTEM WITH STACKABLE SHELLS

CROSS-REFERENCE TO RELATED APPLICATIONS

The present application is a continuation of and claims priority to U.S. patent application Ser. No. 12/554,028, entitled "STORAGE AND ORGANIZATION SYSTEM WITH STACKABLE SHELLS," filed Sep. 4, 2009, which is a non-provisional application of and claimed priority to U.S. Provisional Application No. 61/161,019, entitled "STORAGE AND ORGANIZATION SYSTEM WITH STACKABLE SHELLS," filed on Mar. 17, 2009, both of which are incorporated herein by reference.

This application is also related to the following applications:

U.S. patent application Ser. No. 11/851,165, filed Sep. 6, 2007, now U.S. Pat. No. 7,866,769, issued Jan. 1, 2011;

Pending U.S. patent application Ser. No. 12/960,242, filed Dec. 4, 2010 as a continuation of U.S. patent application Ser. No. 11/851,165;

U.S. patent application Ser. No. 29/284,375, filed Sep. 6, 2007, now U.S. Pat. No. D602,255, issued Oct. 20, 2009;

U.S. patent application Ser. No. 29/284,379, filed Sep. 6, 2007, now U.S. Pat. No. D592,402, issued May 19, 2009;

U.S. patent application Ser. No. 29/329,629, filed Dec. 18, 2008 as a continuation of U.S. patent application Ser. No. 29/284,375, now U.S. Pat. No. D596,857, issued Jul. 28, 2009;

Pending U.S. patent application Ser. No. 12/554,034, filed Sep. 4, 2009 as a non-provisional application claiming priority to U.S. Provisional Application No. 61/160,977, filed on Mar. 17, 2009;

U.S. patent application Ser. No. 29/333,915, filed on Mar. 17, 2009, now U.S. Pat. No. D622,959, issued on Sep. 7, 2010

U.S. patent application Ser. No. 29/368,567, filed Aug. 25, 2010 as a divisional of U.S. patent application Ser. No. 29/333,915, now U.S. Pat. No. D632,892, issued Feb. 22, 2011;

Pending U.S. patent application Ser. No. 29/378,520, filed Nov. 5, 2010 as a divisional of U.S. patent application Ser. No. 29/368,567;

U.S. patent application Ser. No. 29/333,916, filed on Mar. 17, 2009, now U.S. Pat. No. D619,832, issued Jul. 20, 2010;

U.S. patent application Ser. No. 29/358,558, filed on Mar. 29, 2010 as a divisional of U.S. patent application Ser. No. 29/333,916, now U.S. Pat. No. D619,829;

U.S. patent application Ser. No. 29/333,917, filed on Mar. 17, 2009, now U.S. Pat. No. D617,582, issued Jun. 15, 2010;

U.S. patent application Ser. No. 29/361,912, filed on May 17, 2010 as a continuation of U.S. patent application Ser. No. 29/333,917, now U.S. Pat. No. D634,567, issued Mar. 22, 2011; and U.S. patent application Ser. No. 29/333,918, filed on Mar. 17, 2009, now U.S. Pat. No. D605,896, issued Dec. 15, 2009;

all of which are incorporated herein by reference.

BACKGROUND OF THE INVENTION

Many organization and storage items and systems are available to assist consumers in storing and organizing their belongings. However, in general, consumers continually accumulate items and/or transfer items from one location in a home to another. Accordingly, a storage and organization system that may function well for a consumer at one point in time may gradually become ill suited for the consumer's needs at a subsequent time. In order to adapt to their changing needs, consumers often discard and replace old organization systems with new, more suitable systems. In this manner, as the needs of a consumer continue to evolve, a cycle of implementing and replacing organization systems often occurs. This cycle, which may seem to be never ending, can leave a consumer frustrated and distraught with attempts to organize the typically increasing inventory of belongings according to the consumer's evolving use of such belongings.

SUMMARY OF THE INVENTION

One aspect of the present invention relates to a storage shell including sidewalls and rails. The sidewalls each extend between two others of the sidewalls to collectively define a chamber therebetween. The sidewalls create a plurality of intersection lines each being defined along a boundary between two of the plurality of sidewalls. The plurality of are rails each coupled to and radially extends away from a different corresponding one of the plurality of intersection lines relative to a center of the storage shell. Each of the plurality of rails is formed with a Y-shaped cross-section. Related products, systems, components and methods are also disclosed and provide additional advantages.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention is merely exemplary in nature and is not intended to limit the invention or the application and uses of the invention. Furthermore, there is no intention to be bound by any theory presented in the preceding background of the invention or the following detailed description of the invention.

A storage and organization system according to the embodiments described herein is configured to store a plurality of goods, such as a consumer's belongings, and to be easily reconfigured to evolve with the changing needs of the consumer. In one example, the system described herein is configured to be assembled without permanency while still providing a sturdy and aesthetically pleasing storage assembly. In one embodiment, although the general components of the system are configured for a plurality of purposes, additional accessory and other components are provided and configured to interface with the general components to personalize the system for use in a particular area of the home, at a particular time in a consumer's life, etc., based on the needs of the consumer. As such, in one example, the storage and organization system is an adaptable, aesthetically pleasing alternative to the plurality of mismatched organizational units generally available in the prior art.

Figure 1:
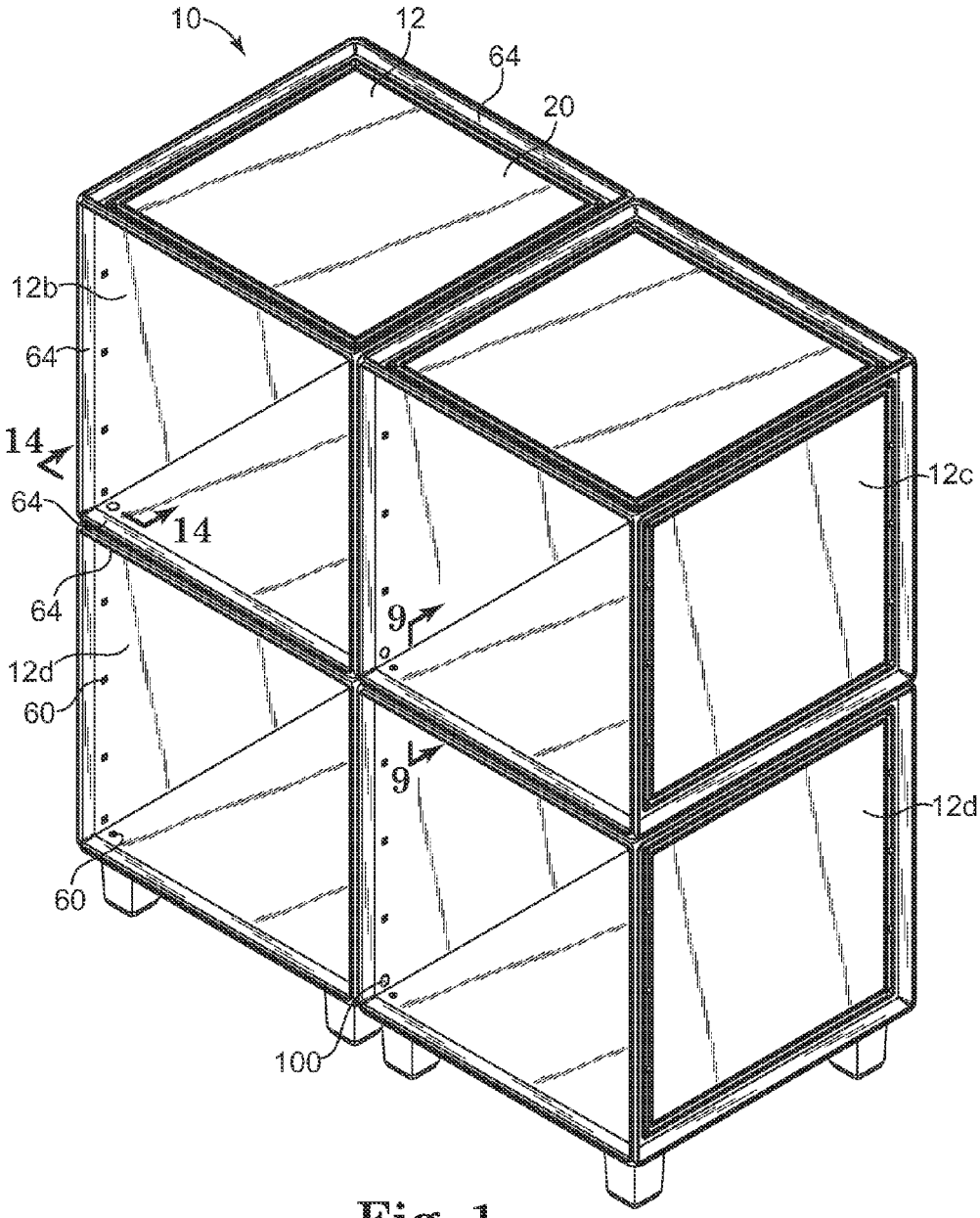
FIG. 1 illustrates a perspective view of a storage and organization system including a plurality of storage shells, according to one embodiment of the present invention.
Figure 2:
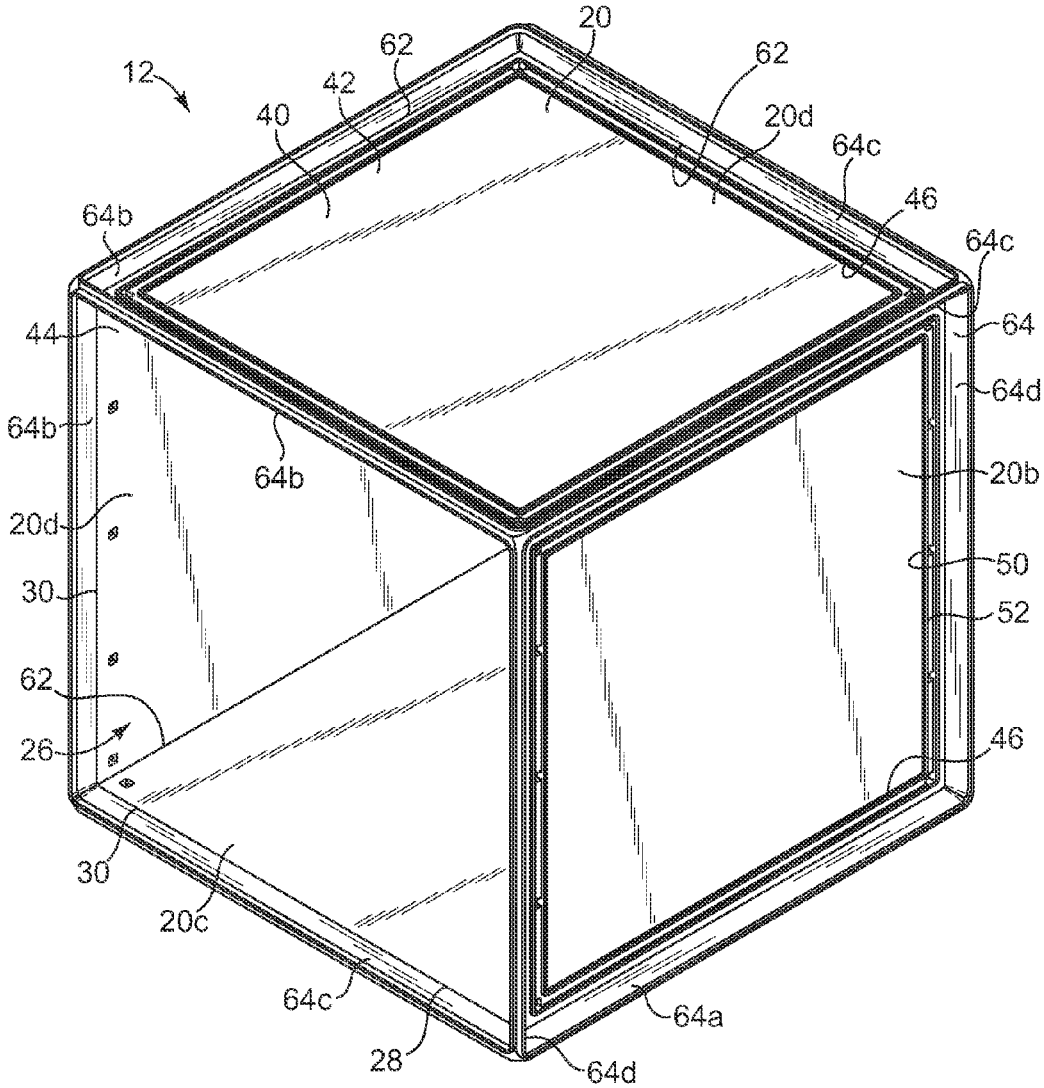
FIG. 2 illustrates a perspective view of a storage shell, according to one embodiment of the present invention.
Figure 3:
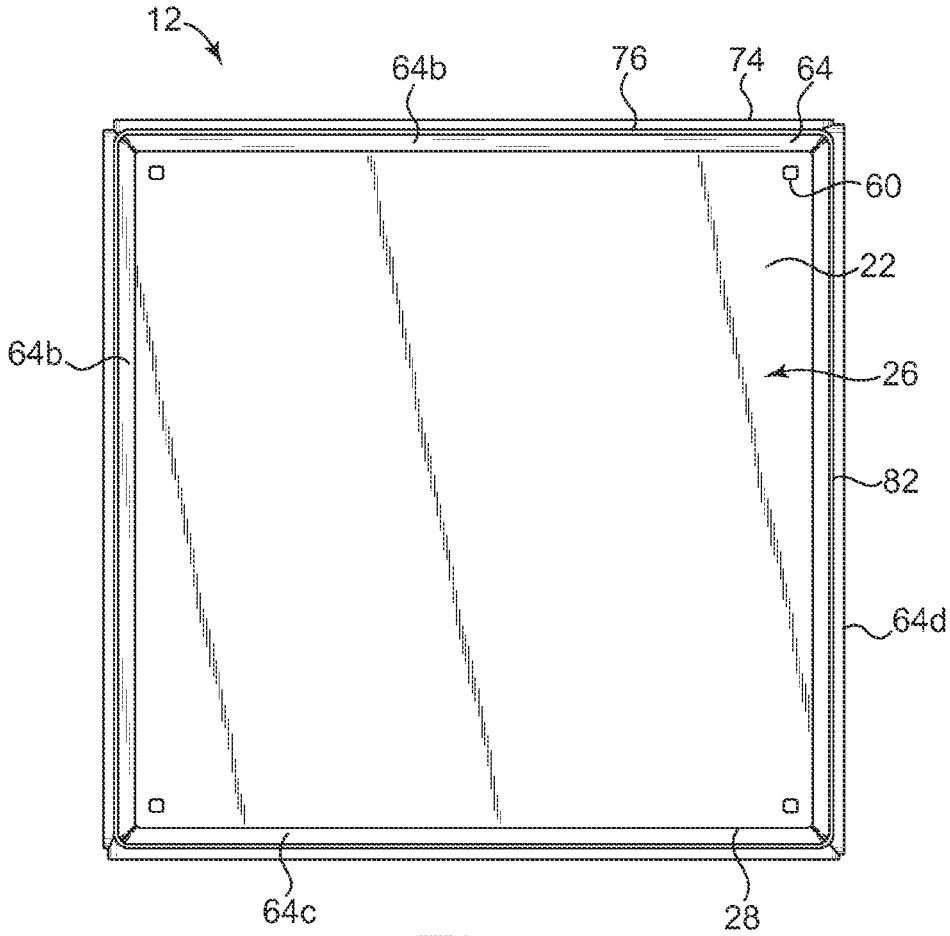
FIG. 3 illustrates a front view of the storage shell of FIG. 1, according to one embodiment of the present invention.
Figure 4:
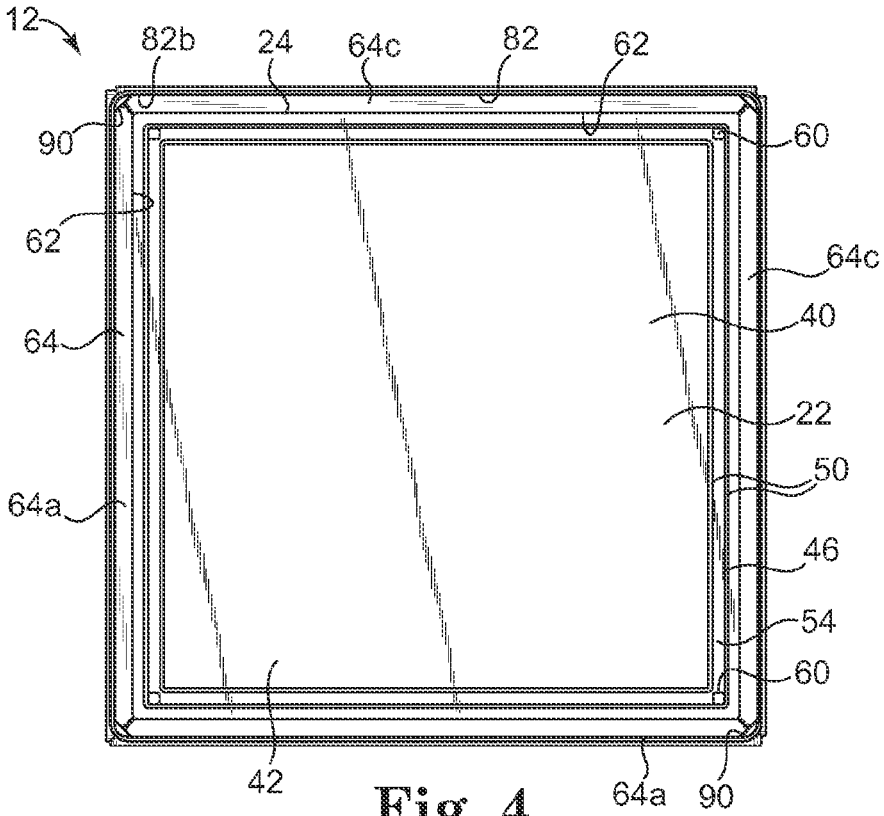
FIG. 4 illustrates a rear view of the storage shell of FIG. 1, according to one embodiment of the present invention.
Figure 5:
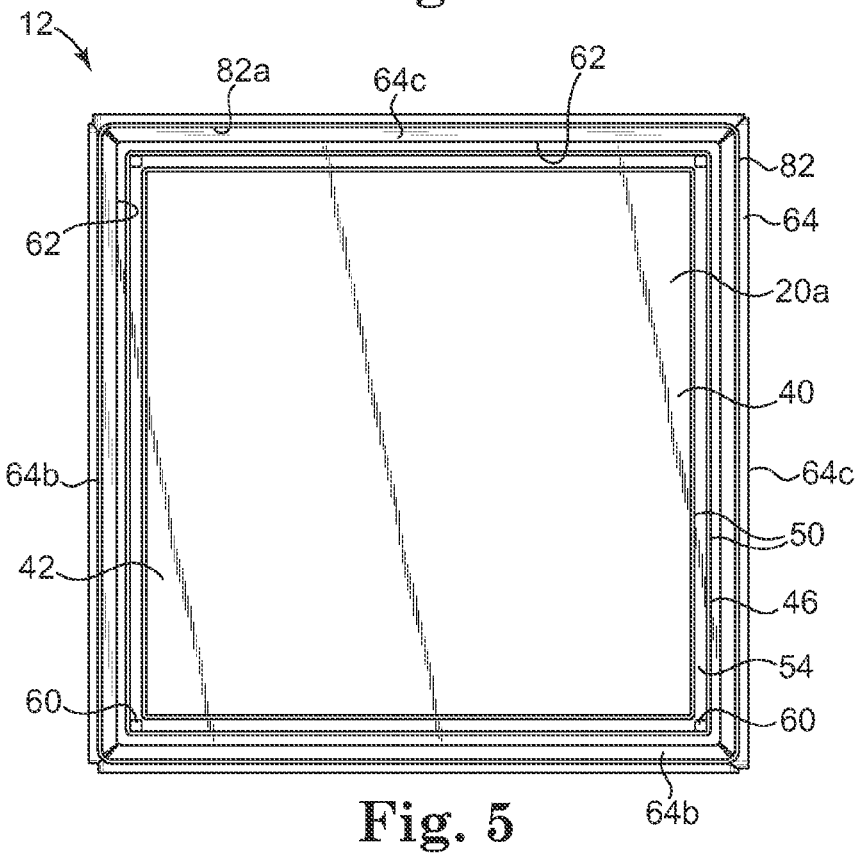
FIG. 5 illustrates a top view of the storage shell of FIG. 1, according to one embodiment of the present invention.
Figure 6:
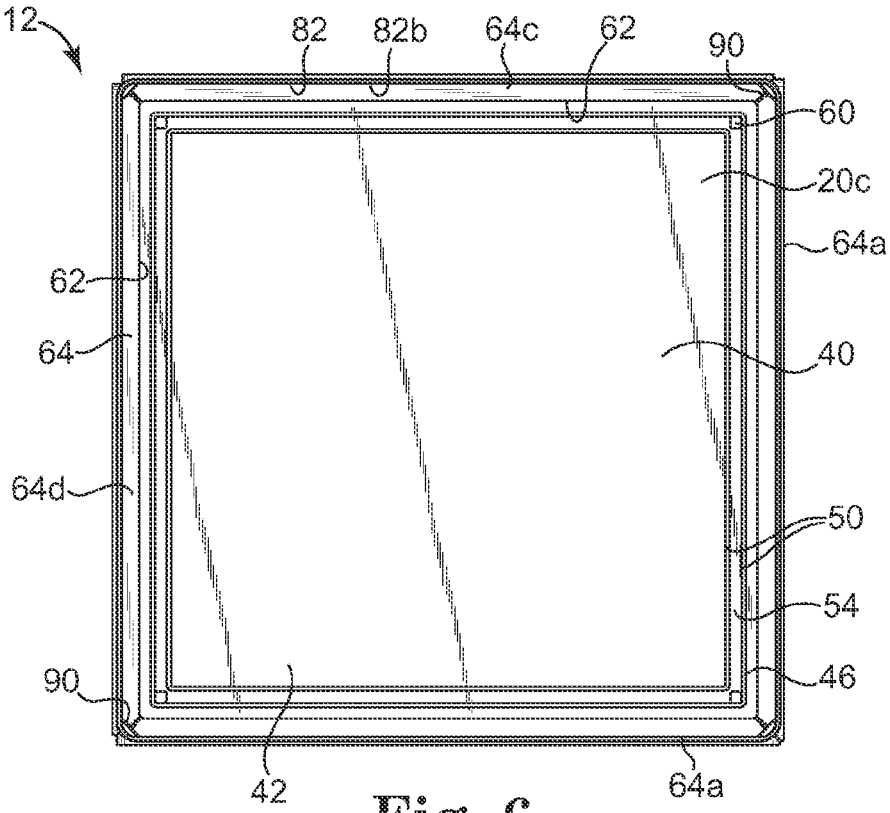
FIG. 6 illustrates a bottom view of the storage shell of FIG. 1, according to one embodiment of the present invention.
Figure 7:
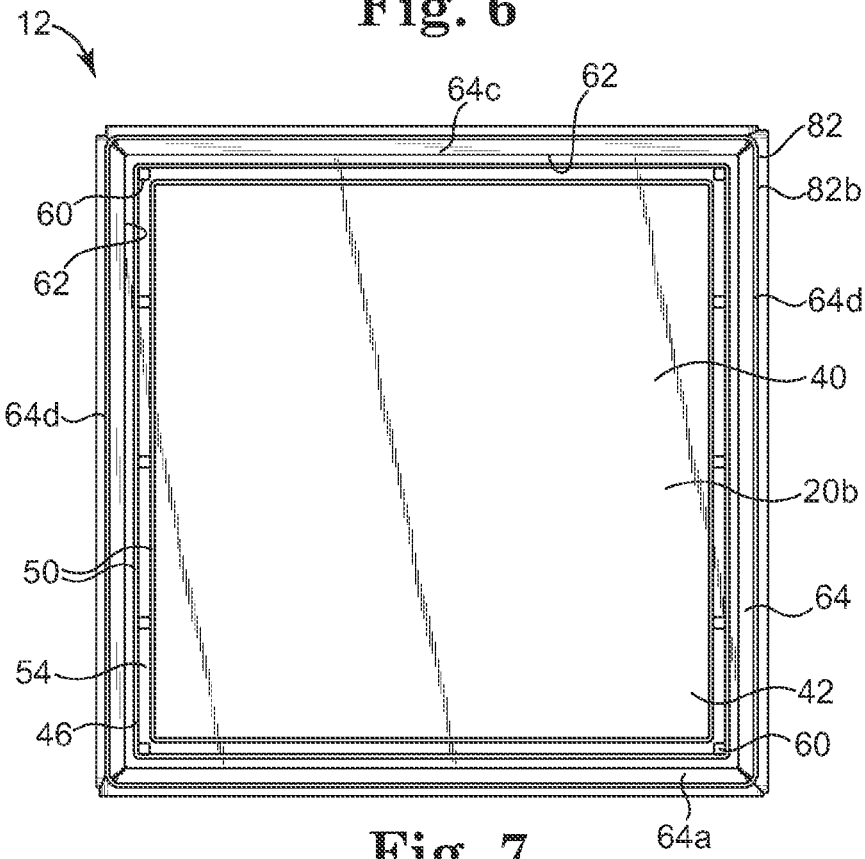
FIG. 7 illustrates a right side view of the storage shell of FIG. 1, according to one embodiment of the present invention.
Figure 8:
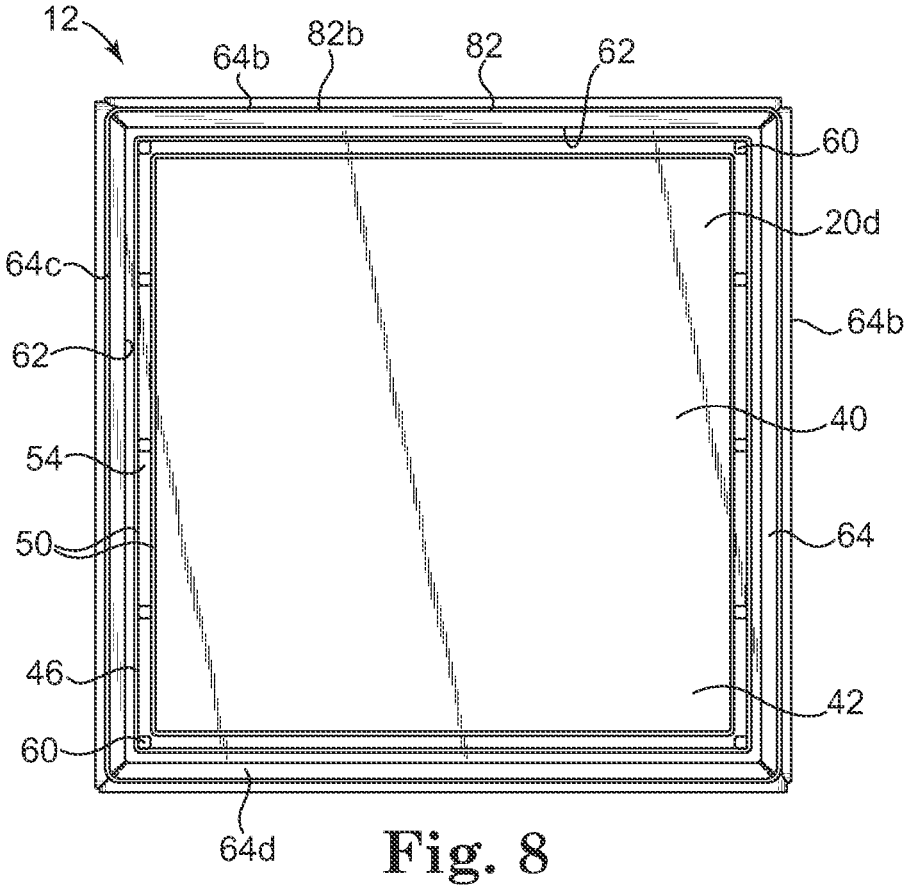
FIG. 8 illustrates a left side view of the storage shell of FIG. 1, according to one embodiment of the present invention.

Turning to the figures, FIG. 1 illustrates a storage and organization system 10 according to one embodiment. The basic building block of storage and organization system 10 is a storage shell 12. Storage shells 12 may be stacked side to side and/or one on top of another in any number of configurations designed by a user/creator of storage and organization system 10. In one embodiment, storage shells 12 fit snuggly in place next to one another such that storage and organization system 10 appears as a more coherent unit not matter what configuration of storage and organization system 10 being created. In addition, the snug fit of adjacent storage shells 12 also provides the resultant storage and organization system 10 with added rigidity and structural integrity as will be apparent to those of skill in the art upon reading this application.

FIGS. 2-8 each generally illustrate storage shell 12 (e.g., a storage box) or at least a portion thereof according to one embodiment of the present invention. In one embodiment, each storage shell 12 defines four sidewalls 20*a*, 20*b*, 20*c*, and 20*d* (collectively referred to as sidewalls 20) and a rear wall 22. Each sidewall 20 is substantially rectangular (e.g., square) and extends between opposite edges of two other sidewalls 20 to define a rectangular box-like structure. Rear wall 22 is coupled to a rear edge 24 of each sidewall 20 such that a compartment 26 (e.g., a cavity, chamber, or void) is defined by storage shell 12 between sidewalls 20 and rear wall 22. A front opening 28 to compartment 26 is defined opposite rear wall 22 and is bordered by a front edge 30 of each of the sidewalls 20 opposite rear edges 24. As such, in one embodiment, storage shell 12 is essentially formed as a rectangular cuboid with an open face (i.e., front opening 28) opposite rear wall 22. In one embodiment, each storage shell 12 is formed from a single material, for example, a suitable plastic material or similar material injection or otherwise molded to form storage shell 12.

Referring to FIG. 1, in one embodiment, each sidewall 20 includes a substantially planar panel 40 in a square or other rectangular shape defining an exterior surface 42 and an interior surface 44 opposite exterior surface 42. In one example, a separate track 46 extends outwardly (i.e., away from compartment 26) from exterior surface 42 of each substantially planar panel 40. Track 46, more specifically, extends around exterior surface 42 inset slightly from outer perimeter edges 48 of the corresponding substantially planar panel 40. As such, an outer perimeter of track 46 is shaped similarly to, but is slightly smaller than, an outer perimeter of a corresponding substantially planar panel 40.

In one example, track 46 includes a pair of concentric ribs 50 defining an opening or groove 54 (e.g., FIG. 4) therebetween. In one example, track 46 as a whole, provides additional rigidity and support to sidewalls 20. For instance, track 46 provides each substantially planar panel 40 with additional strength and decreases twisting, warping, or other deformations of substantially planar panel 40 when storage shell 12 is loaded with goods, etc. In one embodiment, use of track 46 allows substantially planar panel 40 to be formed thinner than if no track 46 were used as will be apparent to those of skill in the art upon reading the present application. Use of thinner walls decreases the amount of material needed to form each storage shell 12 and thereby reduces the cost of manufacturing the resultant storage shells 12.

In one example, one or more apertures or holes 60 extend through each sidewall 20, for example, in groove 54 of track 46. In one embodiment, each hole 60 is substantially square or otherwise rectangular in shape. In one embodiment, a hole 60 is defined in each of the four corners of track 46 in each of the four sidewalls 20 and rear wall 22. Additional holes 60 may be defined along one or more linear lengths of track 46. In one example, some sidewalls 20 include similar numbers and positioning of holes 60 while other sidewalls 20 and/or rear wall 22 may have different numbers and/or arrangements of holes 60. For example, top and bottom sidewalls 20*a* and 20*c*, which are positioned opposite and parallel to one another, only have holes 60 in the corners of the corresponding tracks 46. Vertical sidewalls 20*b* and 20*d*, which are positioned opposite and parallel to one another and perpendicular to top and bottom sidewalls 20*a* and 20*c*, include holes 60 in the corners of the corresponding tracks 46 and additionally each include a plurality of holes 60 linearly spaced at equal distances from one other along at least two of the linear lengths of each track 46. For example, vertical sidewalls 20*b* and 20*d* each have a plurality of holes 60 defined in portions of the groove 54 defined along the front and rear lengths (i.e., the vertical lengths) of the corresponding tracks 46.

A corner, boundary or intersection line 62 (e.g., FIG. 2) is generally defined at the border between any one sidewall 20, rear wall 22, or front opening 28 and another sidewall 20, rear wall 22, or front opening 28. Accordingly, in one embodiment, twelve intersection lines 62 are formed by storage shell 12 including four around front opening 28, four around rear wall 22, and four extending front to back and being defined at the boundary between adjacent sidewalls 20. In one embodiment, a rail 64 extends radially outwardly with respect to a center of the corresponding storage shell 12 from one or more of the intersection lines 62, for example, from every intersection line 62. In one example, rail 64 intersects a respective intersection line 62. As used herein, "radially" refers to a divergent extension of a member relative to a center of a corresponding storage shell 12 unless another reference point is specifically provided. In one embodiment, each rail 64 extends along a substantial entirety of a length of each intersection line 62.

Referring to FIGS. 9-14, in one embodiment, each rail 64 is substantially Y-shaped and includes a primary leg or flange 70 and first and second auxiliary lengths or legs 74 and 76. Flange 70 is substantially planar and extends from the corresponding intersection line 62 to define an outer end 72 opposite the corresponding intersection line 62. In one embodiment, each flange 70, and therefore, rail 64, radially extends from intersection line 62 at an angle $\alpha_1$ between about 30° and about 60° as measured from each adjacent sidewall 20, rear wall 22, or front opening 28, for example, at angle $\alpha_1$ of about 45° as illustrated, for example, in FIG. 11. As such, each flange 70 extends around each sidewall 20, rear wall 22, and front opening 28.

Figure 11:
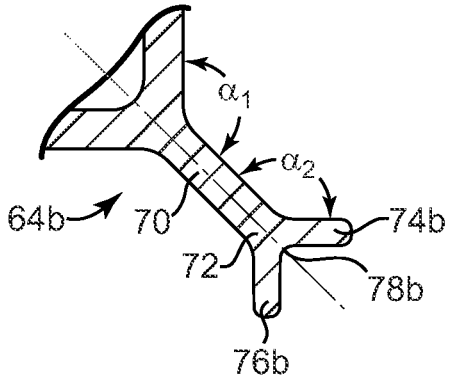
FIG. 11 illustrates a partial cross-sectional view of a rail of the storage shell of FIG. 1, according to one embodiment of the present invention.

Referring to FIG. 11, in one example, first and second auxiliary legs 74 and 76 each extend from outer end 72 of flange 64. Each of first and second auxiliary legs 74 and 76 diverges as it extends from outer end 72 of flange 64. In one embodiment, first and second auxiliary legs 74 and 76 are orientated substantially perpendicularly relative to one another. In one example, each of first and second auxiliary legs 74 and 76 extend from flange 70 with an angle $\alpha_2$ between about 30° and about 60°, for example, at angle $\alpha_2$ of about 45°. In one embodiment, each auxiliary leg 74 and 76 extends parallel to one of sidewalls 20 immediately adjacent the corresponding rail 64.

In order to facilitate nesting of storage shells 12 to one another, at least two different rail 64 types, for example, four different rail 64 types, are included in each storage shell 12, the four different types of rails 64 being illustrated in FIGS. 9-13 including rail 64*a*, rail 64*b*, rail 64*c*, and rail 64*d*. As used herein, rails 64 generically refer to a rail of any one of the types, while rails 64*a*, 64*b*, 64*c*, and 64*d* are used to specifically identify a rail type. A similar numbering convention will be used for other related parts. The different types of rails 64 vary in the lengths of first and second auxiliary legs 74 and 76 and the position of an intersecting point 78 between first and second auxiliary legs 74 and 76 relative to an extension of a dissecting center line of flange 70. For purposes of description, a length of each auxiliary leg 74 and 76 is considered as measured from a corresponding intersecting point 78 to a far end of each auxiliary leg 74 and 76.

Figure 10:
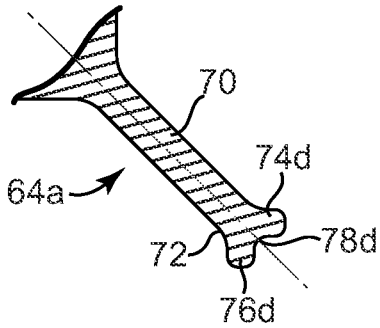
FIG. 10 illustrates a partial cross-sectional view of a rail of the storage shell of FIG. 1, according to one embodiment of the present invention.

More specifically, FIG. 10 illustrates a first type of rail 64*a*. First type of rail 64*a* includes first and second auxiliary legs 74*a* and 76*a* that each extend from intersecting point 78*a* a similar, albeit relatively small, distance. Intersecting point 78*a* is positioned along the centerline of flange 70 such that first type of rail 64*a* is substantially symmetrical. FIG. 11 illustrates second type of rail 64*b*, which is substantially similar to first type of rail 64*a* other than the distance first and second auxiliary legs 74*b* and 76*b* extend from intersecting point 78*b*. In particular, first and second auxiliary legs 74*b* and 76*b* are considerably longer than first and second auxiliary legs 74*a* and 76*a*. In rail 64*b*, first and second auxiliary legs 74*b* and 76*b* are symmetrical such that intersecting point 78*b* is positioned along centerline of flange 70.

Figure 12:
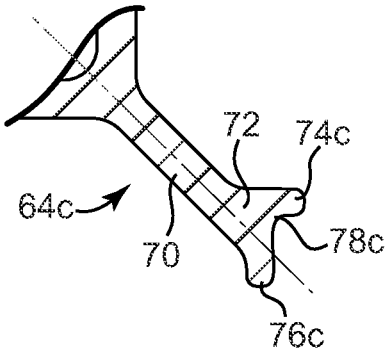
FIG. 12 illustrates a partial cross-sectional view of a rail of the storage shell of FIG. 1, according to one embodiment of the present invention.

FIG. 12 illustrates a third type of rail 64*c*. Rail 64*c* is asymmetrical with first auxiliary leg 74*c* being considerably shorter than second auxiliary leg 74*c*. Furthermore, intersecting point 78*c* is positioned off the centerline of flange 70. More specifically, intersecting point 78*c* is positioned nearer first auxiliary leg 74*c*. In this manner, while second auxiliary leg 76*c* is longer than first auxiliary leg 74*c* as measured from intersecting point 78*c*, first auxiliary leg 74*c* actually extends further away from the centerline of flange 70 than second auxiliary leg 76*c*.

Figure 13:
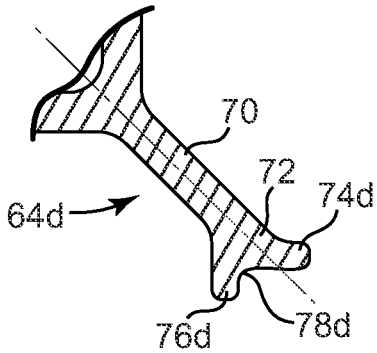
FIG. 13 illustrates a partial cross-sectional view of a rail of the storage shell of FIG. 1, according to one embodiment of the present invention.

FIG. 13 illustrates a fourth type of rail 64*d*, which is substantially similar to third type of rail 64*c* with the characteristics of first auxiliary leg 74 and second auxiliary leg 76 being switched with one another. In particular, in one example, rail 64*d* is asymmetrical with first auxiliary leg 74*d* being considerably longer than second auxiliary leg 74*d*. Furthermore, intersecting point 78*d* is positioned off the centerline of flange 70, for example, nearer second auxiliary leg 76*d*. In this manner, while first auxiliary leg 74*d* is longer than second auxiliary leg 76*d* as measured from intersecting point 78*d*, second auxiliary leg 76*d* actually extends further away from the centerline of flange 70 than first auxiliary leg 74*d*.

In one embodiment, flange 70, first auxiliary leg 74 and second auxiliary leg 76 of each rail 64 are substantially coextensive along a linear length of a side edge of one of sidewalls 20, rear wall 22, and/or front opening 28. In one embodiment, at corners of storage shells 12, auxiliary legs 74 and 76 of rails 64 are joined with auxiliary legs 74 and 76 of other rails 64 extending into the same corner. More specifically, auxiliary legs 74 and 76 of rails 64 are joined with auxiliary legs 74 and 76 of other rails 64 to define a rounded transition corner between two adjoining auxiliary legs 74 and/or 76.

In one embodiment, the above-described treatment of rails 64 at each corner results in four auxiliary legs 74 and 76 collectively defining a rim 82 extending substantially around one of sidewalls 20, rear wall 22, and front opening 28 of storage shell 12 as illustrated in any of FIGS. 3-8. Each rim 82 may be continuous (e.g., closed-loop) or segmented into separate portions and extends substantially perpendicular to the one of sidewalls 20, rear wall 22, and front opening 28 around which it extends. For example, the first auxiliary legs 74 of each of four rails 64 around top sidewall 20*a* collectively form rim 82 extending around top sidewall 20*a* with an orientation substantially perpendicular to top sidewall 20*a*. In one embodiment, a total of six rims 82 are formed, in particular, one around each sidewall 20, one around rear wall 22, and one around front opening 28. In one example, due to the differences in the lengths of first and second auxiliary legs 74 and 76 depending on the type of rail 64 used, rims 82 corresponding to different sidewalls 20, rear wall 22, front opening 28 are sized differently. In view of the above, each rail 64 partially defines two corresponding rims 82.

In one example, two resultant sizes of rims 82 are provided including a smaller rim 82*a* and a larger rim 82*b*. Each rim size is selected based on the expected stacking of multiple storage shells 12. More specifically, where bottom sidewall 20*c* of a storage shell 12 is likely to be placed on a top sidewall 20*a* of another storage shell 12, when the two storage shells 12 are stacked on one another, one of top sidewall 20*a* and bottom sidewall 20*c* is surrounded by smaller rim 82*a* while the other is surrounded by larger rim 82*b*. For example, as illustrated in FIGS. 2-8, bottom sidewall 20*c* of storage shell 12 is formed with larger rim 82*b* while top sidewall 20*a* is defined with smaller rim 82*a*. Larger rim 82*b* is sized to be larger than smaller rim 82*a* by just slightly more than twice a thickness of rims 82. As such, when two storage shells 12 are stacked on one another, smaller rim 82*a* around top sidewall 20*a* of a first shell 12*a* (FIG. 1) fits or nests entirely and just inside larger rim 82*b* of bottom sidewall 20*c* of an adjacent second shell 12*b* (FIG. 1) as generally illustrated in dashed lines relative to the bottom sidewall 20*c* of second storage shell 12*b* in FIG. 15.

In one embodiment, one or more of the larger rims 82*b* defined by each storage shell 12 includes corner supports 90

Figure 15:
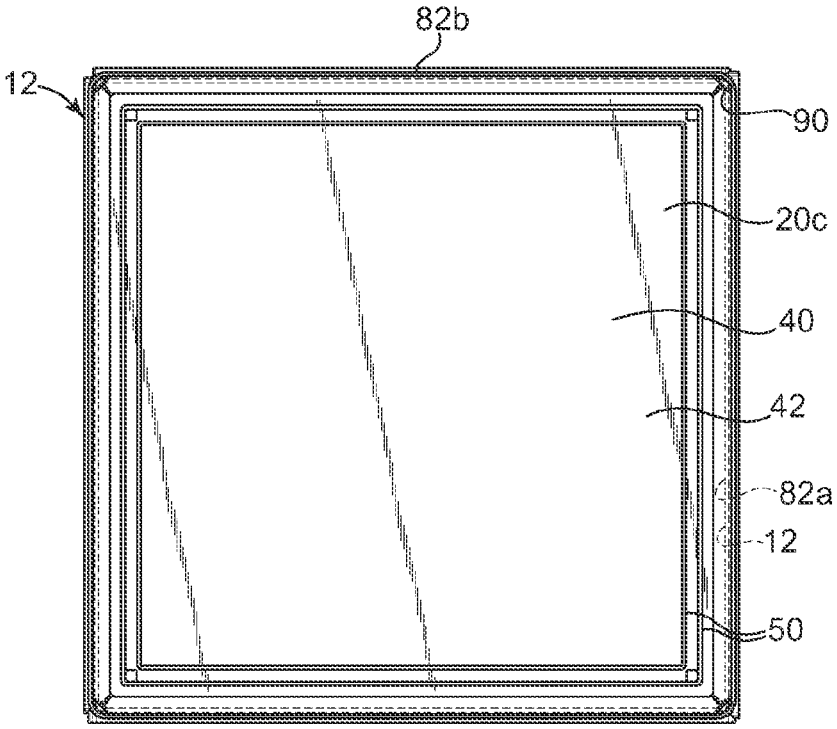
FIG. 15 illustrates a bottom view of the storage shell of FIG. 1 with portions of a second shell illustrated in dashed lines, according to one embodiment of the present invention.

(e.g., FIG. 15) defining a surface just below larger rim 82*b* and configured to facilitate support corners of smaller rim 82*a* and the associated storage shell 12 in an even and stable manner as will be apparent to those of skill in the art upon reading this application including viewing FIG. 15. Interaction between corresponding ones of smaller rim 82*a* and larger rim 82*b* facilitates positioning of adjacent storage shells 12 such that even without coupling mechanisms, storage shells 12 generally remain in place relative to one another from front to back and from right to left. When joined with coupling mechanisms the resultant storage and organization system 10 is substantial rigid, sturdy, and configured to safely store even relatively weighty items at the pleasure of the user.

Figure 16:
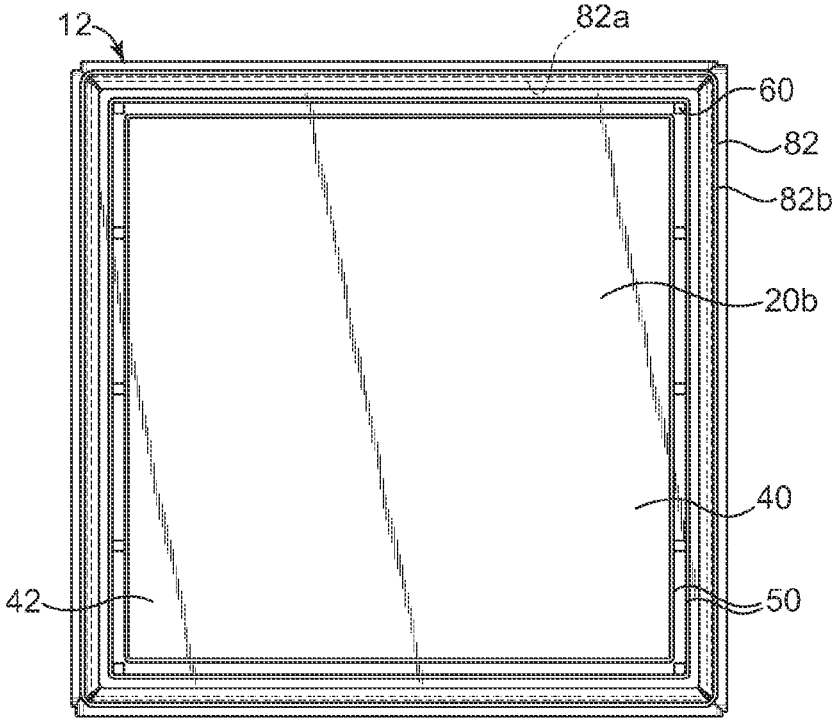
FIG. 16 illustrates a right side view of the storage shell of FIG. 1 with portions of a second shell illustrated in dashed lines, according to one embodiment of the present invention.
Figure 17:
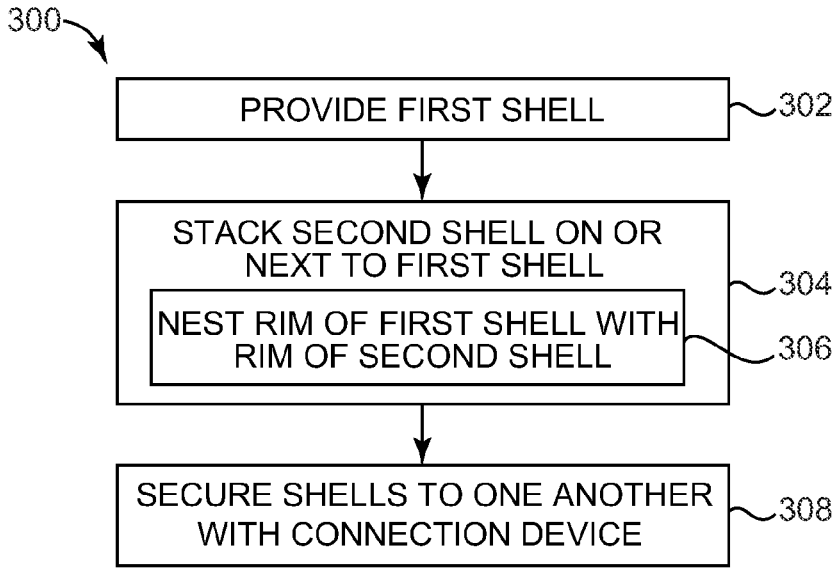
FIG. 17 illustrates a flow chart for a method of creating a storage and organization system, according to one embodiment of the present invention.

As will be apparent to those of skill in the art upon reading this application, other sidewalls 20 likely to face one another upon stacking and positioning of multiple storage shells 12 to define any storage and organization system 10 are provided with complimentary rims 82, i.e., one smaller rim 82*a* and one larger rim 82*b*. For example, as illustrated, right sidewall 20*b* is surrounded by larger rim 82*b* and left sidewall 20*d* is surrounded by smaller rim 82*a*. As such, when two similar storage shells 12 are positioned next to each other the smaller rim 82*a* of a left sidewall 20*d* of one storage shell 12 is nested within larger rim 82*b* of an adjacent right sidewall 20*b* of another of storage shells 12 as illustrated with dashed lines in the right side storage shell 12 view of FIG. 16.

Figure 9:
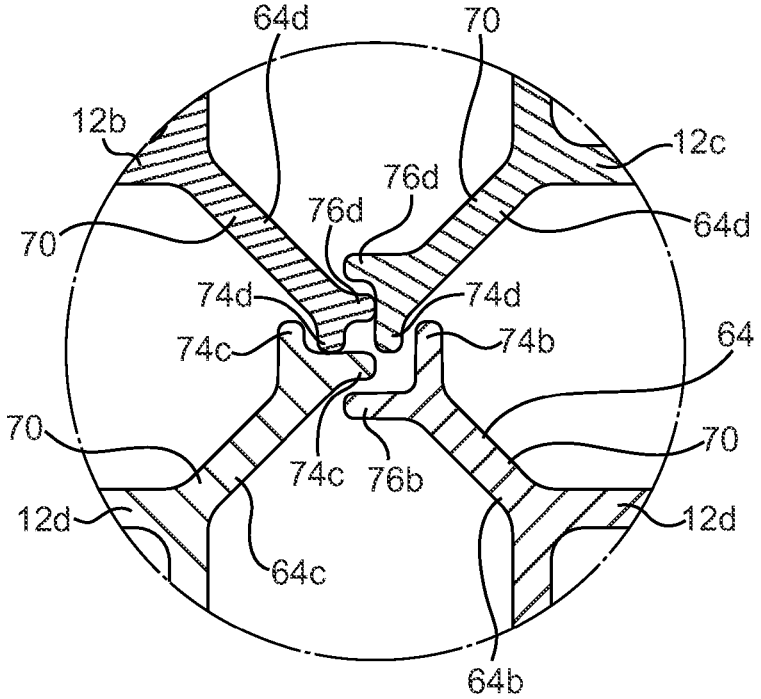
FIG. 9 illustrates a cross-sectional view as indicated by the line 9-9 in FIG. 1, according to one embodiment of the present invention.

Sizing and positioning of rims 82 around sidewalls 20, etc. is also determined to facilitate stacking of storage shells 12 both up and down and side by side, for example, as illustrated in FIG. 1. For instance, as shown in the cross-sectional view of FIG. 9, both top-to-bottom and side-to-side coupling features are utilized and work together. More specifically, the four rails 64 work together to nest with one another to create a stable storage and organization system 10. In one embodiment, none of the four rails 64 of FIG. 9 are of the same type. The desired size of rim 82 to extend around each sidewall 20, rear wall 22, and front opening 28 dictate which type of rail 64 will be used along each intersection line 62. Particular types of rails 64 used in the illustrated embodiments are indicated in FIGS. 3-8 by the proper reference number with designating character as will be apparent to those of skill in the art upon reading this application where each rail 64 is identified from the perspective of looking from the front opening 28 toward rear wall 22, from right sidewall 20*b* toward left sidewall 20*d*, or from top sidewall 20*a* toward bottom sidewall 20*c*, whichever is appropriate given the orientation of the particular rail 64 being identified.

In one embodiment, when shells 12 are stacked, two or more (e.g., all four) of rails 64 adjacent top sidewall 20*a* of first storage shell 12*a* interact with two or more (e.g., all four) of rails 64 adjacent bottom sidewall 20*c* of second storage shell 12*b*. In one example, when the above-described rails 64 interact, second auxiliary legs 76 of rails 64 adjacent top sidewall 20*a* of first storage shell 12*a* are positioned adjacent and nest with first auxiliary legs 74 of rails 64 adjacent bottom sidewall 20*c* (e.g., as illustrated with reference to the cross-sectional view of FIG. 14). This nesting substantially maintains second storage shell 12*b* in place relative to first storage shell 12*a*, more particularly in place from side to side and from front to back of storage shells 12. For example, second auxiliary legs 76 of rails 64 adjacent top sidewall 20*a* of first storage shell 12*a* extend just inside first auxiliary legs 74 of rails 64 adjacent bottom sidewall 20*c*. The opposite configuration of second auxiliary legs 76 of rails 64 adjacent top sidewall 20*a* of first storage shell 12*a* and first auxiliary legs 74 of rails 64 adjacent bottom sidewall 20*c* may alternatively be used as will be apparent to those of skill in the art upon reading this application.

Figure 14:
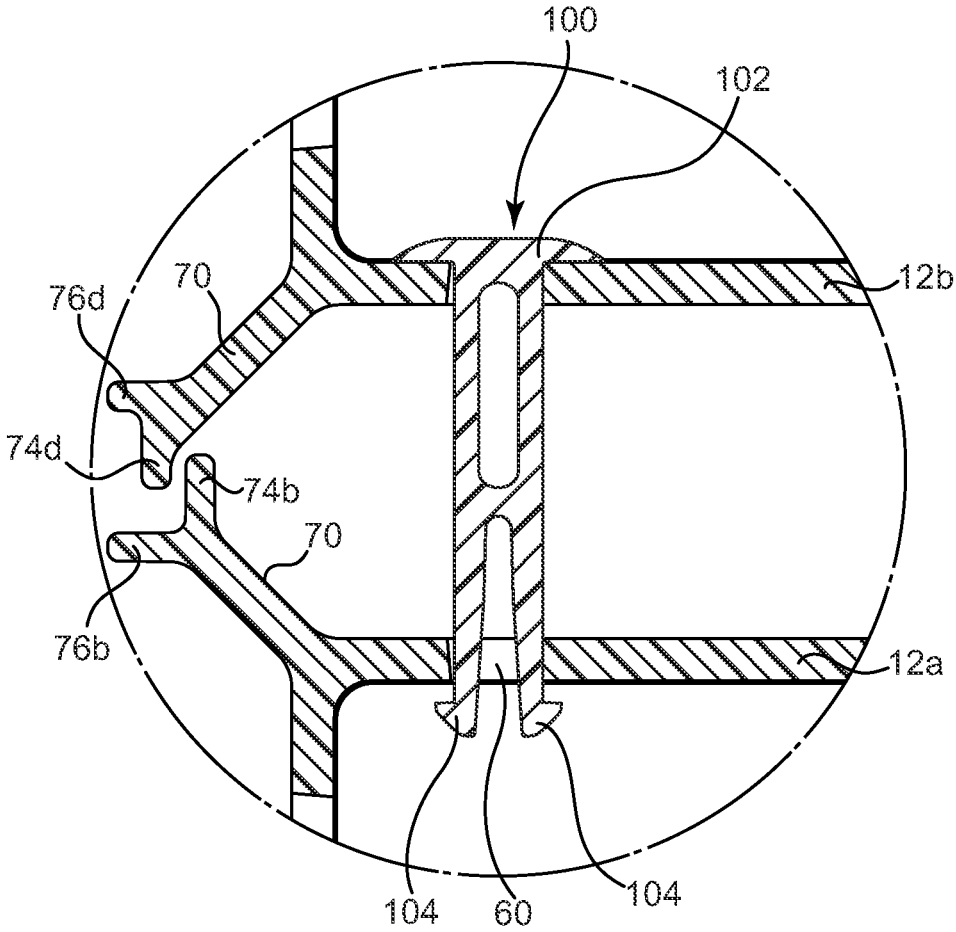
FIG. 14 illustrates a cross-sectional view as indicated by the line 14-14 in FIG. 1, according to one embodiment of the present invention.

In one embodiment, when adjacent storage shells 12 are coupled to one another, sidewalls 20 of one storage shell 12 are all maintained spaced from and do not contact sidewalls 20 of other storage shells 12. In other words, storage shells 12 only contact each other via rails 64. Also, when storage shells 12 are stacked, holes 60 extending through corresponding sidewalls 20 thereof align with one another (e.g., from front to back and from left to right). As illustrated in FIG. 14, clips 100 are used to secure adjacent storage shells 12 to one another. For example, clip 100 may be used including a head 102 and two symmetrical legs 104 configured to be flexed toward one another to facilitate coupling of clip 100 to and removal of clip 100 from a corresponding storage shell 12. Other suitable connecting devices are also contemplated.

Figure 18:
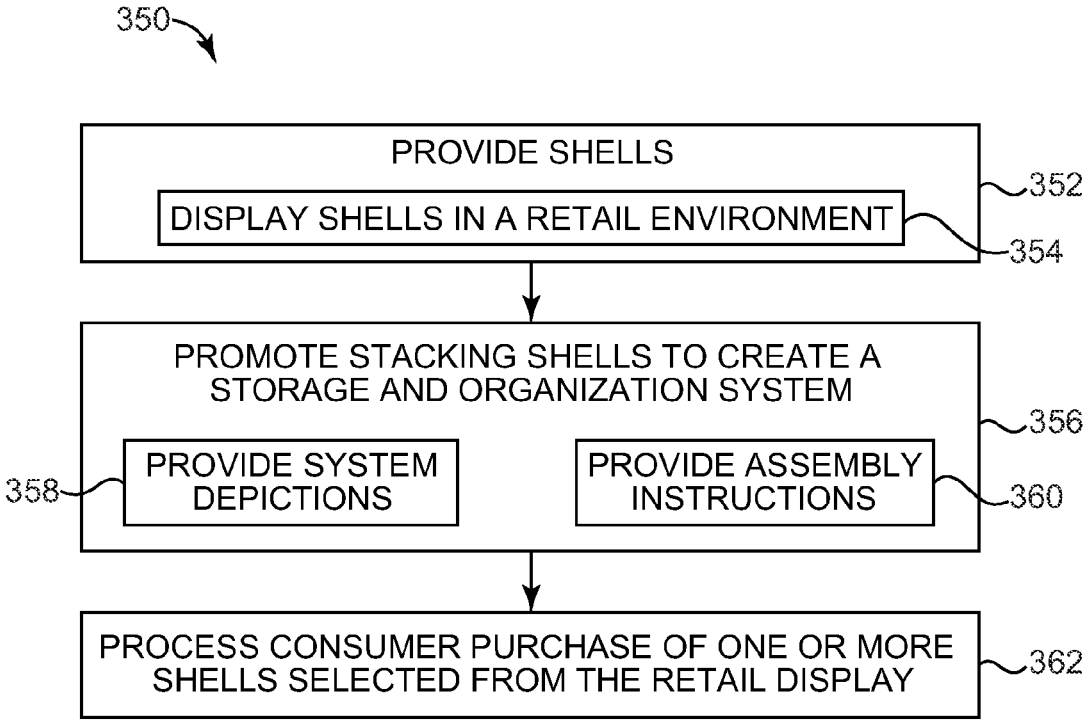
FIG. 18 illustrates a flow chart for a method of providing a storage and organization system, according to one embodiment of the present invention.

FIG. 18 is a flow chart generally illustrating one embodiment of a method 300 of using storage and organization system 10 as described with respect to at least FIGS. 1-9. At 302, a first storage shell 12*a* is provided having similar properties as described above. At 304, a second shell 12*b*, which is substantially similar to, for example, identical to, first storage shell 12*a*, is stacked on or next to first storage shell 12*a*. In one embodiment, stacking at 304 includes nesting one rim 82 of first storage shell 12*a* with a corresponding rim 82 of second storage shell 12*b*. For example, where second storage shell 12*b* is staked on first storage shell 12*a*, larger rim 82*b*, which extends around bottom sidewall 20*c* of second storage shell 12*b*, is positioned around smaller rim 82*a*, which extends around top sidewall 20*a* of first storage shell 12*a*, such that smaller rim 82*a* of first storage shell 12*a* is nested within larger rim 82*b* of second storage shell 12*b*. Similarly, if, at 204, shells 12*a* and 12*b* are stacked next to one another, then, in one example, a larger rim 82*b* around right sidewall 20*b* of first storage shell 12*a* is positioned around a smaller rim 82*a* around left sidewall 20*d* of second storage shell 12*b*.

In one example, once shells 12*a* and 12*b* are properly positioned and stacked relative to one another, one or more connection device, such as clips 100, are placed through a sidewall 20 of first storage shell 12*a* and a sidewall 20 of second storage shell 12*b*, more specifically, through holes 60 formed therein, to selectively maintain first and second storage shells 12*a* and 12*b* coupled to one another. In one example, clips 100 allow shells 12 to be secured to one another without requiring any tools other than clips 100 themselves. In one embodiment, no connection devices are used. Other steps of configuring and creating a storage and organization system 10 will be apparent to those of skill in the art. For example, auxiliary members (not shown) such as trays shelves, drawers, baskets, bins, etc. may be coupled with one or more of shells 12 in storage and organization system 10 to further customize storage and organization system 10 for one or more particular uses.

FIG. 18 illustrates one embodiment of a method 350 of providing a storage and organization system 10. For example, at 352, storage shells 12, for example, first storage shell 12*a*, second storage shell 12*b*, third storage shell 12*c*, etc., are provided. In one embodiment, providing storage shells 12 at 302 includes displaying storage shells 12 as part of a retail display in a retail environment such that shells 12 are viewable by potential consumers at 304. Notably, retail environment may be a tangible, "brick-and-mortar" location or may be a more intangible environment, such as an Internet web site, associated with a retailer.

At 356, retailer or provider of shells 12 promotes that shells 12 are stackable side by side and/or up and down to create custom storage and organization units 10. In one embodiment, such promotion at 356 includes proving depictions of sample storage and organization units providing examples and inspiration to potential consumers of how to use shells 12 for their storage and organizational needs. In one embodiment, promoting at 256 also or alternatively includes providing assembly instructions at 360. In one example, instructions themselves provide inspiration for additional uses of shells 12 and/or additional inspiration for using shells 12 or constructing predefined or other storage and organization systems 10.

When a consumer decides to purchase one or more shells 12 and/or accessories for use therewith, in one embodiment, the shells 12 and/or accessories or at least representations thereof are moved from the retail display or other corresponding storage space to a point-of-sale terminal (e.g., cash register, kiosk, home computer, etc.) so that they can be processed for sale at 362. Although method 350 is illustrated as a series of operations, in one embodiment, at least operations 352 and 356 can be performed in any order and/or substantially simultaneously with one another.

Although the invention has been described to particular embodiments, such embodiments are for illustrative purposes only and should not be considered to limit the invention. Various alternatives and modifications within the scope of the invention in its various embodiments will be apparent to those with ordinary skill in the art upon reading this application.

What is claimed is:

1. A storage shell comprising:

a plurality of sidewalls each extending between two others of the plurality of sidewalls to collectively define a chamber therebetween, wherein the plurality of sidewalls create a plurality of intersection lines each being defined along an outermost edge of a boundary between two of the plurality of sidewalls; and a plurality of rails each intersecting and radially extending away from a different corresponding one of the plurality of intersection lines relative to a center of the storage shell, wherein each of the plurality of rails is formed with a Y-shaped cross-section, and the plurality of rails includes at least two different types of Y-shaped rails.

2. The storage shell of claim 1, wherein each of the plurality of rails comprises:

a primary flange extending from a respective intersection line to define an end opposite the respective intersection line;

a first auxiliary leg extending from the end of the primary flange; and a second auxiliary leg extending from the end of the primary flange;

wherein the first auxiliary leg and the second auxiliary leg extend substantially perpendicular to one another.

3. The storage shell of claim 2, wherein the first auxiliary leg extends parallel to one of the plurality of sidewalls adjacent the respective intersection line, and the second auxiliary leg extends parallel to a different one of the plurality of sidewalls adjacent the respective intersection line.

4. The storage shell of claim 2, wherein the primary flange extends from the respective intersection line to form an angle of between about 30° and about 60° between the primary flange and one of the plurality of sidewalls adjacent the respective intersection line.

5. The storage shell of claim 4, wherein an angle of between about 30° and about 60° is defined between the primary flange and the first auxiliary member and between the primary flange and the second auxiliary member.

6. The storage shell of claim 2, wherein the first auxiliary legs of at least two of the plurality of rails are joined to one another.

7. The storage shell of claim 2, wherein four of the plurality of rails extend around one of the plurality of sidewalls, wherein the first auxiliary leg of each of the four of the plurality of rails are each joined to one another at ends thereof to define a continuous rim extending around the one of the plurality of sidewalls.

8. The storage shell of claim 7, wherein the continuous rim is concentric with the one of the plurality of sidewalls and is larger than an outer perimeter of the one of the plurality of sidewalls.

9. The storage shell of claim 8, wherein the storage shell is a first storage shell and is in combination with a second storage shell similar to the first storage shell, and a continuous rim of the second storage shell extends around the continuous rim of the first storage shell when the first storage shell is stacked with the second storage shell.

10. The storage shell of claim 8, wherein a different continuous rim is similarly defined around each one of the plurality of sidewalls.

11. The storage shell of claim 2, wherein each type of the at least two different types of Y-shaped rails includes at least one of the first auxiliary leg and the second auxiliary leg having a different length than at least one of the first auxiliary leg and the second auxiliary leg of every other type of the at least two different types of Y-shaped rails.

12. The storage shell of claim 2, wherein the primary flange extends substantially unsupported from the respective intersection line to the end of the primary flange.

13. The storage shell of claim 1, wherein one of the at least two different types of Y-shaped rails is symmetrical and another one of the at least two different types of Y-shaped rails is asymmetrical.

14. The storage shell of claim 13, wherein each of the plurality of rails comprises:

a primary flange extending from the respective intersection line to define an end opposite the respective intersection line;

a first auxiliary leg extending from the end of the primary flange; and a corresponding second auxiliary leg extending from the end of the primary flange;

wherein the first auxiliary leg and the second auxiliary leg extend substantially perpendicular to one another, and one of the at least two different types of Y-shaped rails includes the first auxiliary leg having a length substantially equal to a length of the corresponding second auxiliary leg, and one of the at least two different types of Y-shaped rails includes the first auxiliary leg having a length that differs from a length of a corresponding second auxiliary leg.

15. The storage shell of claim 1, wherein the storage shell is formed as a single contiguous piece of material.

16. A storage and organization system comprising:

a first box having four first box side panels and a plurality of first box flanges, the four first box side panels are coupled to one another to define a first box chamber therebetween, each of the plurality of first box flanges extends from a first box outer perimeter edge of one of the four first box side panels, the plurality of first box flanges collectively defining a first box rim extending perpendicular to and being radially spaced from the one of the four first box side panels, wherein each of the first box flanges is formed with a Y-shaped cross-section, and the first box rim extends substantially entirely around the one of the first box side panels; and a second box having four second box side panels and a plurality of second box flanges, the four second box side panels are coupled to one another to define a second box chamber therebetween, each of the plurality of second box flanges extends from a second box outer perimeter edge of one of the four second box side panels, the plurality of second box flanges collectively defining a second box rim extending perpendicular to and being radially spaced from the one of the four second box side panels, wherein each of the second box flanges is formed with a Y-shaped cross-section, and the second box rim extends substantially entirely around the one of the second box side panels;

wherein the first box rim is similarly shaped and slightly larger than the second box rim, and when the first box is stacked with the second box, the first box rim extends around the second box rim and the one of the four first box side panels remains spaced from the one of the four second box side panels.

17. The system of claim 16, wherein each of the plurality of the first box flanges comprises:

a primary leg extending from the first box outer perimeter edge of one of the four first box side panels, a first auxiliary leg extending from an end of the primary leg opposite the first box outer perimeter edge, wherein the first auxiliary leg defines a portion of the first box rim, and a second auxiliary leg extending from the end of the primary leg in a different direction than the first auxiliary leg.

18. The system of claim 17, wherein the second auxiliary leg defines a portion of a different rim that extends substantially entirely around a different one of the second box side panels that is adjacent the one of the second box side panels.

19. The system of claim 17, wherein the second auxiliary leg extends substantially parallel to the one of the four first box side panels.

20. A method of providing a storage and organization system, the method comprising:

displaying a first shell in a retail environment, wherein the first shell is shaped as a rectangular cupoid with an open face, the first shell comprising:

a plurality of sidewalls including a first sidewall and a second sidewall opposite and extending substantially parallel to the first sidewall, and a plurality of rails, wherein a different one of the plurality of rails each being formed with a Y-shaped cross-section radially extends from each corner of the first shell, the plurality of rails including:

a first portion of the plurality of rails, each of the first portion of the plurality of rails is positioned adjacent the first sidewall of the first shell and collectively defines a first rim spaced from, extending substantially perpendicular to, and extending around the first sidewall, and a second portion of the plurality of rails, each of the second portion of the plurality of rails is positioned adjacent the second sidewall of the first shell and collectively defines a second rim spaced from, extending substantially perpendicular to, and extending around the second sidewall, wherein the first rim is shaped similarly to and sized smaller than the second rim; and displaying depictions of the storage and organization system using shells representative of the first shell, the depictions illustrating the shells stacked with one another such that first rims and second rims of the shells nest with one another to facilitate selective coupling and stacking of the shells with one another.

* * * * *